US012679603B2

(12) United States Patent
Kim et al.

(10) Patent No.: US 12,679,603 B2
(45) Date of Patent: Jul. 14, 2026

(54) SUBSTANCE CONTAINER

(71) Applicant: YONWOO CO., LTD., Incheon (KR)

(72) Inventors: Min Goo Kim, Incheon (KR); Jae Hyun Seo, Incheon (KR)

(73) Assignee: YONWOO CO., LTD., Incheon (KR)

( * ) Notice: Subject to any disclaimer, the term of this patent is extended or adjusted under 35 U.S.C. 154(b) by 124 days.

(21) Appl. No.: 18/833,273

(22) PCT Filed: Mar. 7, 2023

(86) PCT No.: PCT/KR2023/003071
§ 371 (c)(1),
(2) Date: Jul. 25, 2024

(87) PCT Pub. No.: WO2023/172015
PCT Pub. Date: Sep. 14, 2023

(65) Prior Publication Data

US 2025/0108959 A1 Apr. 3, 2025

(30) Foreign Application Priority Data

Mar. 8, 2022 (KR) ..... 10-2022-0029386

(51) Int. Cl.
*B65D 47/20* (2006.01)
*A45D 40/00* (2006.01)
*B65D 35/46* (2006.01)

(52) U.S. Cl.
CPC ..... *B65D 35/46* (2013.01); *B65D 47/2018* (2013.01)

(58) Field of Classification Search
CPC .... B65D 35/46; B65D 43/161; B65D 47/061; B65D 47/2018; B65D 47/2081;
(Continued)

(56) References Cited

U.S. PATENT DOCUMENTS 5,518,147 A * 5/1996 Peterson ..... B05B 11/1097 222/153.07
6,688,495 B2 * 2/2004 Masuda ..... B65D 47/2018 222/493
(Continued)

FOREIGN PATENT DOCUMENTS

DE 9311617 U1 9/1994
EP 0103600 B1 2/1986
(Continued)

*Primary Examiner* — Luan K Bui
(74) *Attorney, Agent, or Firm* — Bridgeway IP Law Group, PLLC; Sang Ho Lee; Hyun Woo Shin

(57) ABSTRACT

According to an embodiment of the present invention is provided a container. The container includes: a container part for storing a content therein; a connection part provided on top of the container part and having at least one or more inlets adapted to introduce the content thereinto; a discharging part ascended and descended along the connection part and having an outlet for discharging the content, the outlet being open and closed according to ascending and descending; a cap part located on top of the discharging part and having an insertion hole adapted to insert the discharging part thereinto; and an elastic member disposed between the discharging part and the cap part to apply an elastic force to the discharging part, wherein the elastic member is a bellows type member having a peak and troughs formed in a longitudinal direction thereof, while being sealed on the peripheral surface thereof.

11 Claims, 4 Drawing Sheets

(58) Field of Classification Search
CPC ..... A45D 34/00; A45D 40/00; A45D 2040/0006; A45D 2200/054
USPC ..... 222/209, 212, 213, 420, 422, 494–496, 222/498–499, 511, 513–514, 518
See application file for complete search history.

(56) References Cited

U.S. PATENT DOCUMENTS

| | | | | |
|---|---|---|---|---|
| 6,974,053 | B2 * | 12/2005 | Lautre | B65D 47/2081 222/493 |
| 7,059,501 | B2 * | 6/2006 | Masuda | B65D 83/771 222/212 |
| 8,534,509 | B2 * | 9/2013 | Duquet | B65D 47/2068 222/496 |
| 8,783,520 | B2 * | 7/2014 | Hagleitner | A47K 5/1207 222/207 |
| 8,863,998 | B2 * | 10/2014 | Painchaud | B65D 47/2031 222/1 |
| 2010/0116852 | A1 * | 5/2010 | Painchaud | B65D 47/18 222/496 |
| 2020/0223599 | A1 | 7/2020 | Painchaud et al. | |

FOREIGN PATENT DOCUMENTS

| | | | |
|---|---|---|---|
| FR | 787371 | A | 9/1935 |
| FR | 3013337 | A1 | 5/2015 |
| JP | 2005-511430 | A | 4/2005 |
| JP | 2015-048104 | A | 3/2015 |
| JP | 2016-204010 | A | 12/2016 |
| KR | 10-0613174 | B1 | 8/2006 |
| WO | 2012/013894 | A1 | 2/2012 |

* cited by examiner

SUBSTANCE CONTAINER

TECHNICAL FIELD

The present invention relates to a substance container.

BACKGROUND ART

As modern societies have been developed, various cosmetics, medicines, quasi-drugs, etc. are developed and introduced, and accordingly, different types of containers for storing a variety of types and formulations of contents therein are suggested. For example, a content such as cream or gel is stored in a container such as a tube, and if a soft storage portion of the tube is pressurized, a volume of the storage portion decreases, so that the content stored in the tube is discharged to the outside.

If a cap of the tube is open to use the content, however, the content of the tube is exposed immediately to the outside through an open portion of the tube, and when exposed, external air or dust is introduced into the tube through the open portion, so that the content may be contaminated. Therefore, there is a need to develop a container capable of being reliably sealed to prevent the content stored therein from being contaminated with external air or dust.

DISCLOSURE OF THE INVENTION

Technical Problems

It is an object of the present invention to provide a container that is capable of solving the above-mentioned problems occurring in the related art.

The technical problems to be achieved through the present invention are not limited as mentioned above, and other technical problems not mentioned herein will be obviously understood by one of ordinary skill in the art through the following description.

Technical Solutions

To accomplish the above-mentioned objects, according to the present invention, there is provided a container. The container may include: a container part for storing a content therein; a connection part provided on top of the container part and having at least one or more inlets adapted to introduce the content thereinto; a discharging part ascended and descended along the connection part and having an outlet for discharging the content, the outlet being open and closed according to ascending and descending; a cap part located on top of the discharging part and having an insertion hole adapted to insert the discharging part thereinto; and an elastic member disposed between the discharging part and the cap part to apply an elastic force to the discharging part, wherein the elastic member is a bellows type member having a peak and troughs formed in a longitudinal direction thereof, while being sealed on the peripheral surface thereof.

Advantageous Effects of the Invention

According to the present invention, the container is configured to allow the outlet to be closed in a state where the container part is not pressurized, thereby preventing the content from being contaminated, and to allow the outlet to be open if the container part is pressurized, thereby enabling the use of the content with ease.

According to the present invention, further, the container is configured to allow the bellows type elastic member having the peak and troughs formed in a longitudinal direction thereof, while being sealed on the peripheral surface thereof, to open and close the outlet, so that the elastic force of the elastic member increases, the elastic member is more naturally compressed and released from the compressed state, and the elastic force is more easily transferred.

BRIEF DESCRIPTION OF DRAWINGS

To allow the drawings as will be mentioned in the description of the present invention to be more sufficiently understood, the brief description of the drawings may be provided.

BEST MODE FOR INVENTION

Figure 1:
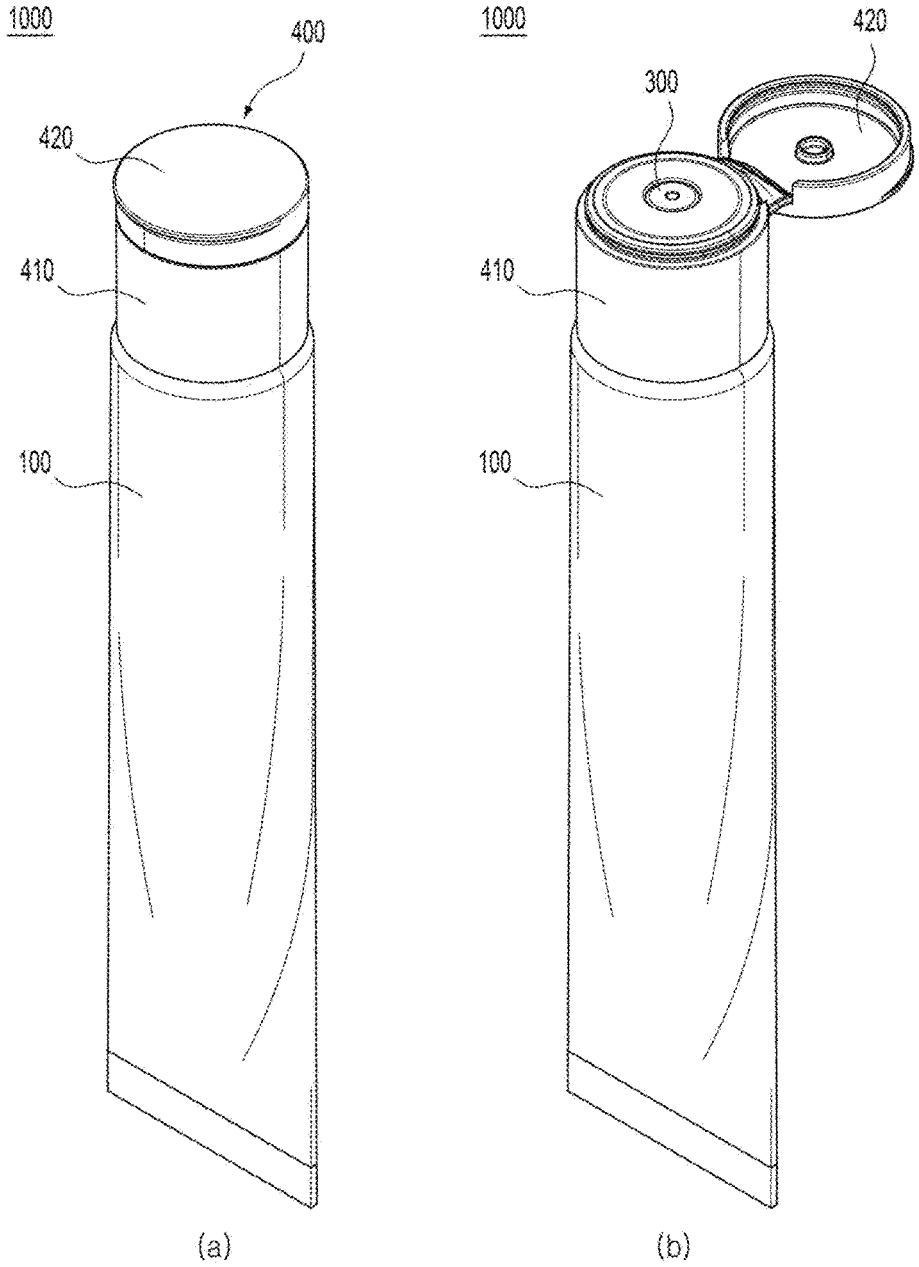
FIG. 1 is a perspective view showing a container according to an embodiment of the present invention.

According to an embodiment of the present invention is provided a container. The container includes: a container part for storing a content therein; a connection part provided on top of the container part and having at least one or more inlets adapted to introduce the content thereinto; a discharging part ascended and descended along the connection part and having an outlet for discharging the content, the outlet being open and closed according to ascending and descending; a cap part located on top of the discharging part and having an insertion hole adapted to insert the discharging part thereinto; and an elastic member disposed between the discharging part and the cap part to apply an elastic force to the discharging part, wherein the elastic member is a bellows type member having a peak and troughs formed in a longitudinal direction thereof, while being sealed on the peripheral surface thereof.

Further, if the container part is pressurized, the content is introduced into the connection part through the inlets to allow the elastic member to be compressed so that the discharging part moves up to open the outlet, and if the pressurization against the container part is released, the elastic member pressurizes the discharging part downward so that the discharging part moves down to close the outlet.

Furthermore, the elastic member includes: a body having the peak and troughs and generating the elastic force when compressed; and a supporter located on the underside of the body to transfer the elastic force to the discharging part.

Besides, the body is bent to first curvature between the peak and the adjacent trough, and the supporter extends downward and outward from the trough on the bottom of the body and is then bent inward from the underside thereof to second curvature different from the first curvature.

Moreover, an inner upper peripheral surface of the body comes into close contact with the cap part and is supported against the cap part, and an outer lower peripheral surface of the supporter comes into close contact with the discharging part and is supported against the discharging part.

Further, the container part includes: a soft storage part for storing the content therein; and a hard shoulder part coupled to a top of the storage part.

Additionally, the connection part includes: a seating portion seated on top of the container part and having the inlets formed thereon; and an opening and closing rod extending upward from a given region of the seating portion inside the inlets and coming into close contact with the inside of the outlet.

Furthermore, if the container part is pressurized, the discharging part moves up to allow the close contact between the opening and closing rod and the outlet to be released so that through the outlet, the content is discharged.

Moreover, the connection part has a peripheral wall extending upward from a given region of the seating portion outside the inlets, and the discharging part has a ring portion ascended and descended, while coming into close contact with the peripheral wall, to prevent the content from leaking.

Further, the cap part includes: a first cap part adapted to surround the connection part and having the insertion hole formed on top thereof; and a second cap part rotatably coupled to the first cap part in such a way as to open and close the insertion hole.

Furthermore, top of the discharging part is aligned with top of the insertion hole or located inside the insertion hole, and if the container part is pressurized, the discharging part moves up and is thus exposed to the outside from the insertion hole.

Mode for Invention

Hereinafter, exemplary embodiments of the present invention will be described in detail with reference to the accompanying drawings. Further, a method for configuring and using a device according to the embodiment of the present invention will be explained in detail with reference to the attached drawings and specification. In the drawings, reference numerals or symbols, with respect to the same elements, even though they may be displayed in different drawings, such elements use same reference numerals as much as possible. Further, top, bottom, left and right directions as will be described below are determined with reference to the drawings, and accordingly, the scope of the present invention is not necessarily restricted to the corresponding directions.

It shall be understood that, although the terms "first," "second," etc. may be used herein to describe various information, the information should not be limited by these terms. These terms are only used to distinguish one category of information from another. For example, a first element may be named a second element without departing from the scope of the present invention. Likewise, a second element may be named a first element.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

In the entire specification, when it is said that one element is described as being "connected" or "coupled" to the other element, one element may be directly connected or coupled to the other element, but it should be understood that another element may be present between the two elements. Further, when it is said that one portion is described as "includes" any component, one element further may include other components unless no specific description is suggested.

Figure 2:
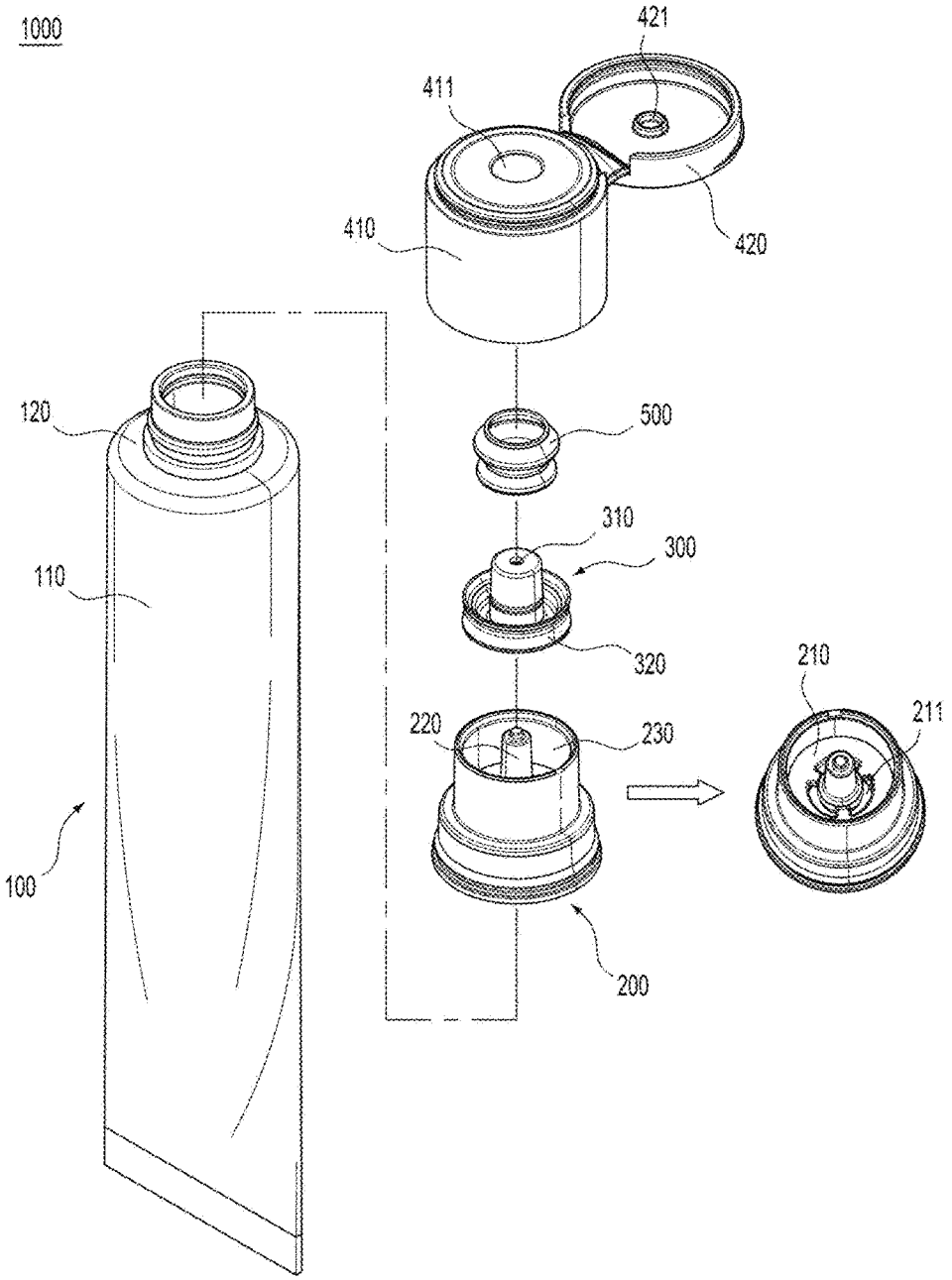
FIG. 2 is an exploded perspective view showing the container according to the embodiment of the present invention.
Figure 3:
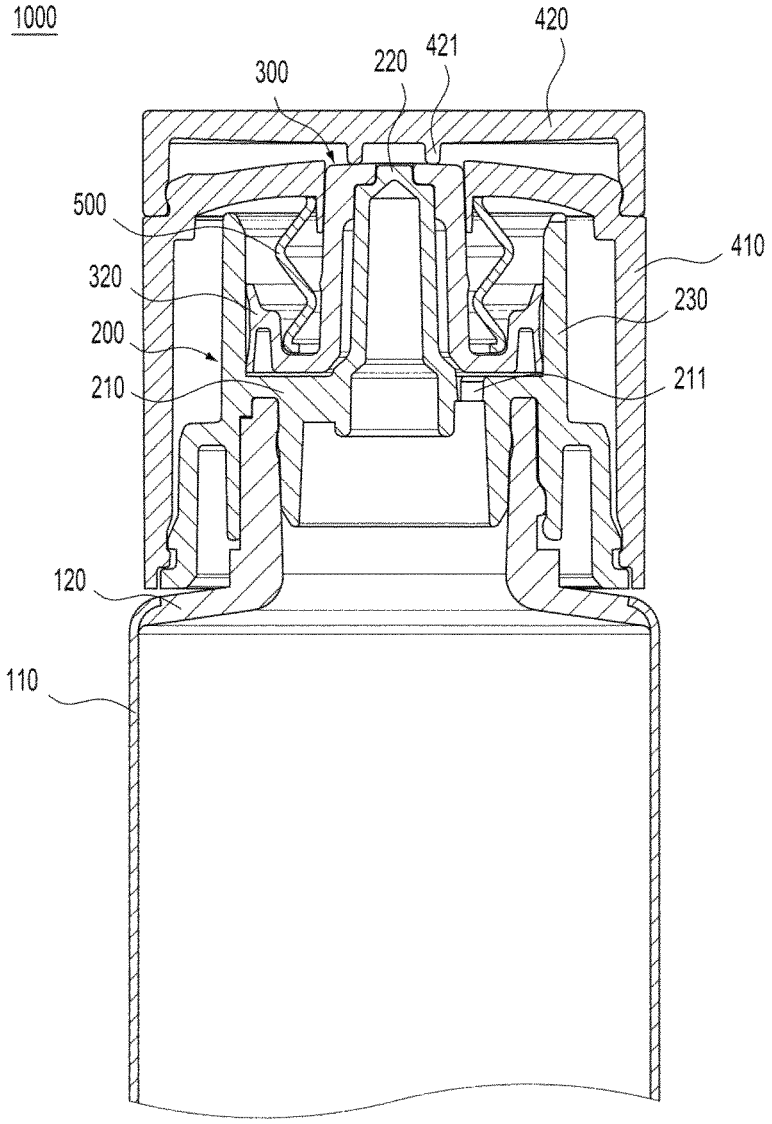
FIG. 3 is a sectional view showing the container according to the embodiment of the present invention.
Figure 4:
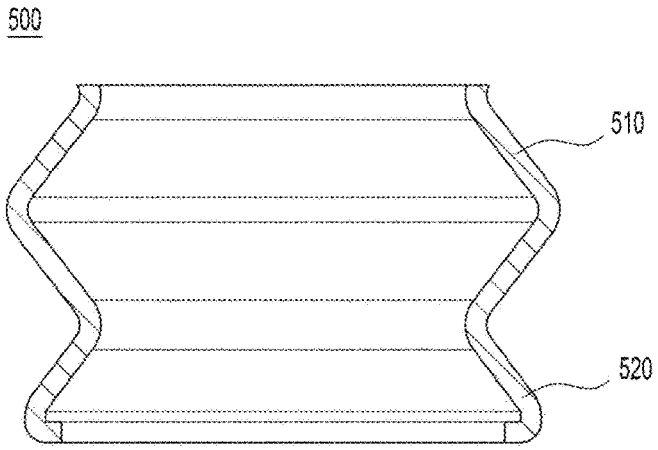
FIG. 4 is a sectional view showing an elastic member of the container according to the embodiment of the present invention.

FIG. 1 is a perspective view showing a container according to an embodiment of the present invention, FIG. 2 is an exploded perspective view showing the container according to the embodiment of the present invention, FIG. 3 is a sectional view showing the container according to the embodiment of the present invention, and FIG. 4 is a sectional view showing an elastic member of the container according to the embodiment of the present invention.

Referring to FIGS. 1 to 4, a container 1000 according to an embodiment of the present invention includes a container part 100, a connection part 200, a discharging part 300, a cap part 400, and an elastic member 500.

The container part 100 stores a given content therein. In this case, the given content is a solid, semi-solid, powder, liquid or gel cosmetic content. For example, the content may be lotion, milk lotion, moisture lotion, nutrition lotion, skin lotion, skin softer, skin toner, astringent, massage cream, nutrition cream, whitening essence, tone-up cream, sunblock, sun cream, sun milk, BB cream, base, foundation, CC cream, concealer, blusher, shade, eyeshadow, eyebrow, eye cream, primer, and the like. However, the content may not be limited thereto, and therefore, the content may include different formulations or types of cosmetics or medicines.

According to the embodiment of the present invention, the container part 100 includes a storage part 110 and a shoulder part 120.

The storage part 110 has a storage space portion for storing a content therein. Further, the storage part 110 is made of a soft material so that when it is pressurized, a volume of the storage space portion decreases. As the volume of storage space portion decreases, the content is discharged to the outside of the storage part 110. For example, the storage part 110 has the shape of a tube, but without being limited thereto, the storage part 110 may have the shapes of all soft containers capable of being decreased in volume when pressurized.

The shoulder part 120 is made of a hard material and coupled to a top of the storage part 110 in such a way as to support the storage part 110. As the shoulder part 120 is made of a hard material, a given region of the storage part 110 coupled to the shoulder part 120 does not decrease in volume when the storage part 110 is pressurized, so that the content stored in the storage part 111 moves to the shoulder part 120. Further, the connection part 200 is disposed inside the shoulder part 120, and the content moving to the shoulder part 120 by means of the pressurization against the storage part 110 is introduced into the connection part 200.

The connection part 200 is provided on top of the container part 100 in such a way as to introduce the content discharged from the container part 100 thereinto. To do this, the connection part 200 has at least one or more inlets 211 adapted to introduce the content. In detail, the content is introduced into the connection part 200 through the inlets 211 when the container part 100 is pressurized.

According to the embodiment of the present invention, the connection part 200 includes a seating portion 210, an opening and closing rod 220, and a peripheral wall 240.

The seating portion 210 is seated on top of the container part 100 and has the inlets 211 formed thereon. In detail, the seating portion 210 is seated on top of the shoulder part 120, and the inlets 211 are formed on top of the seating portion 210. In this case, the inlets 211 are located inside the shoulder part 120 in such a way as to allow the content discharged from the container part 100 to be introduced thereinto.

The opening and closing rod 220 extends upward from the insides of the inlets 211. As a result, the opening and closing rod 220 comes into close contact with the inside of the discharging part 300 (especially the inside of an outlet 310), so that in a state where the container part 100 is not pressurized, the opening and closing rod 220 seals the container 1000.

The peripheral wall 230 extends upward from a given region of the seating portion 210 outside the inlets 211. The peripheral wall 230 comes into close contact with at least a portion of the discharging part 300 (especially a ring portion 320), so that the content introduced into the connection part 200 is prevented from leaking.

The discharging part 300 serves to discharge the content introduced into the connection part 200 to the outside. In this case, the discharging part 300 is ascended and descended along the connection part 200. As the discharging part 300 is ascended and descended, it is determined whether the content is discharged or not. For example, the discharging part 300 is located inside the peripheral wall 230 in such a way as to surround the opening and closing rod 220.

According to the embodiment of the present invention, the discharging part 300 has the outlet 310. The outlet 310 is formed on top of the discharging part 300 in such a way as to be open and closed as the discharging part 300 is ascended and descended. In detail, if the discharging part 300 moves down and is thus in a first position, the outlet 310 comes into close contact with the opening and closing rod 220 and is thus closed, and contrarily, if the discharging part 300 moves up and is thus in a second position, the close contact of the outlet 310 with the opening and closing rod 220 is released so that the outlet 310 is open.

According to the embodiment of the present invention, the discharging part 300 includes the ring portion 320. The ring portion 320 is ascended and descended, while coming into close contact with the peripheral wall 230. That is, the ring portion 320 allows the discharging part 300 to be ascended and descended, while permitting the content introduced into the connection part 200 to be discharged only through the outlet 310 to the outside, so that the content is prevented from leaking inside the container 1000.

The cap part 400 is located on top of the discharging part 300 and surrounds at least portions of the connection part 200, the discharging part 300, and the elastic member 500. In this case, the cap part 400 has an insertion hole 411 adapted to insert the discharging part 300 thereinto, and the discharging part 300 is exposed to the outside from the insertion hole 411.

According to the embodiment of the present invention, top of the discharging part 300 is aligned with top of the insertion hole 411 or located inside the insertion hole 411, and if the container part 400 is pressurized, the discharging part 300 moves up and is thus exposed to the outside from the insertion hole 411. In the state where the container part 400 is not pressurized, top of the discharging part 300 is not exposed to the outside, and therefore, the discharging part 300 is prevented from being contaminated.

According to the embodiment of the present invention, the cap part 400 includes a first cap part 410 adapted to surround the connection part 200 and having the insertion hole 411 formed on top thereof; and a second cap part 420 rotatably coupled to the first cap part 410 in such a way as to open and close the insertion hole 411. In this case, for example, at least one hinge part is located between the first cap part 410 and the second cap part 420 to allow the first cap part 410 and the second cap part 420 to be rotatably coupled to each other, but without being limited thereto, various rotatable coupling structures may be applied to allow the first cap part 410 and the second cap part 420 to be rotatably coupled to each other.

According to the embodiment of the present invention, the second cap part 420 has a pressurizing portion 421 protruding from an underside thereof. The pressurizing portion 421 serves to pressurize top of the discharging part 300, if the second cap part 420 closes the insertion hole 411, to prevent the discharging part 300 from unintentionally moving up, so that the content is prevented from being unintentionally discharged to the outside.

The elastic member 500 is disposed between the discharging part 300 and the cap part 400 to apply an elastic force to the discharging part 300. If the container part 100 is pressurized to allow the content to be introduced into the connection part 200, the elastic member 500 is compressed so that the discharging part 300 moves up to open the outlet 310, and contrarily, if the pressurization against the container part 100 is released, the elastic member 500 pressurizes the discharging part 300 downward so that the discharging part 300 moves down to close the outlet 310.

According to the embodiment of the present invention, the elastic member 500 is a bellows type member having a peak and troughs formed in a longitudinal direction thereof, while being sealed on the peripheral surface thereof. In this case, the elastic force of the elastic member 500 increases, and the elastic member 500 is naturally compressed and released from the compressed state. Further, even if the bellows type elastic member 500 is made of a plastic material, not a metal material, it exerts an appropriate elastic force.

According to the embodiment of the present invention, the elastic member 500 includes a body 510 having the peak and troughs and generating the elastic force when compressed; and a supporter 520 located on the underside of the body 510 to transfer the elastic force to the discharging part 300.

According to the embodiment of the present invention, the body 510 is bent to first curvature between the peak and the trough, and the supporter 520 extends downward and outward from the trough on the bottom of the body 510 and is then bent inward from the underside thereof to second curvature different from the first curvature. In this case, for example, the second curvature is larger than the first curvature. As a result, a degree of an external force required for the compression of the supporter 520 bent to the second curvature is bigger than a degree of an external force required for the compression of the body 510 bent to the first curvature. That is, as the body 510 is bent to the first curvature, it is compressed to a first compression rate when compressed, and as the supporter 520 is bent to the second curvature, it is compressed to a second compression rate lower than the first compression rate when compressed. The body 510 is compressed to the first compression rate to generate the elastic force, and the supporter 520 is compressed to the second compression rate and stably transfers the elastic force downward.

According to the embodiment of the present invention, the inner upper peripheral surface of the body 510 comes into close contact with the cap part 400 and is supported against the cap part 400, and the outer lower peripheral surface of the supporter 520 comes into close contact with the discharging part 300 and is supported against the discharging part 300. As a result, the elastic member 500 is prevented from escaping when compressed and released from the compressed state, and further, the transfer direction of the elastic force is induced in a vertical direction.

The container 1000 as shown in FIGS. 1 to 4 is just exemplary, and therefore, the container 1000 may have various configurations according to embodiments of the present invention.

Figure 5:
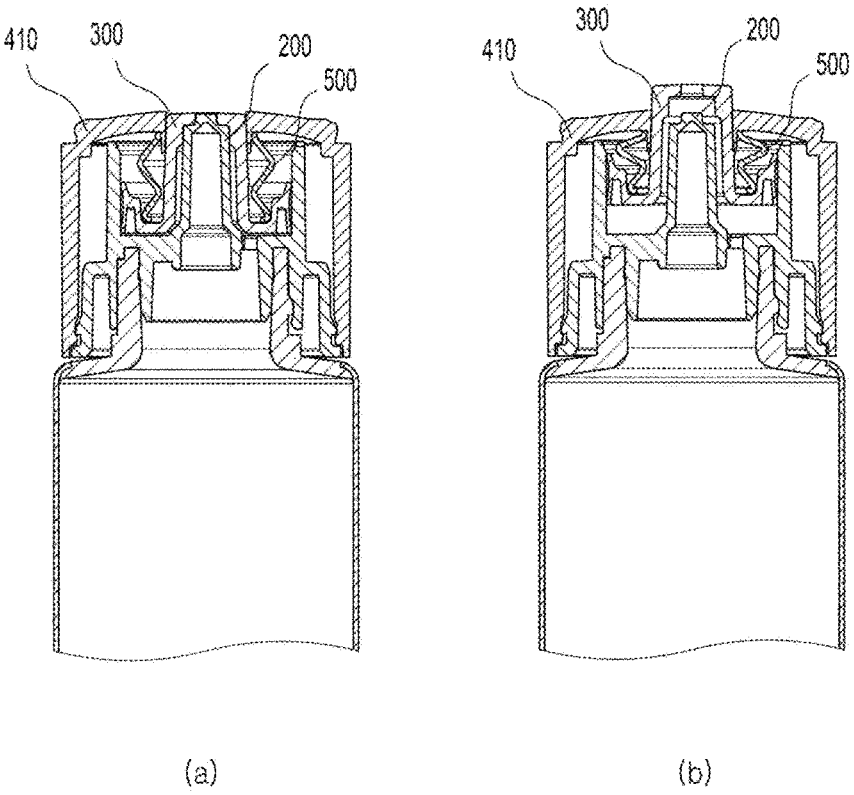
FIG. 5 is a sectional view showing operations of the container according to the embodiment of the present invention.

FIG. 5 is a sectional view showing operations of the container according to the embodiment of the present invention. In detail, FIG. 5*a* is a sectional view showing a state of the container 1000 where the container part 100 is not pressurized, and FIG. 5*b* is a sectional view showing a state of the container 1000 where the container part 100 is pressurized.

Referring to FIG. 5, in the state where the container part 100 is not pressurized, the opening and closing rod 220 comes into close contact with the inside of the outlet 310 so that the outlet 310 is closed.

If the container part 100 is pressurized, the content stored in the storage part 110 moves to the shoulder part 120 and is introduced into the connection part 200 through the inlets 211. If the content moves to the connection part 200, the elastic member 500 is compressed to move up the discharging part 300. As the discharging part 300 moves up, the close contact between the outlet 310 and the opening and closing rod 220 is released to open the outlet 310. If the outlet 310 is open, the content moving to the connection part 200 is discharged to the outside through the outlet 310.

After that, if the pressurization against the container part 100 is released, the compressed elastic member 500 pressurizes the discharging part 300 downward to move down the discharging part 300. As the discharging part 300 moves down, the outlet 310 comes into close contact with the opening and closing rod 220 again and is thus closed.

The operations of the container 1000 as shown in FIG. 5 are just exemplary, and therefore, the operations of the container 1000 may be freely performed according to embodiments of the present invention.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be therefore understood that the embodiments of the present invention are just exemplary embodiments, while not limiting the present invention. Persons skilled in the relevant art can appreciate that many modifications and variations are possible in light of the above teachings. It is therefore intended that the scope of the invention be limited not by this detailed description, but rather by the claims appended hereto.

The invention claimed is:

1. A container comprising:

a container part for storing a content therein;

a connection part provided on top of the container part and having at least one or more inlets adapted to introduce the content thereinto;

a discharging part having an outlet for discharging the content, and configured to ascend and descend along the connection part by an elastic force of an elastic member, wherein the outlet opens as the discharging part ascends and closes as the discharging part descends;

a cap part located on top of the discharging part and having an insertion hole adapted to insert the discharging part thereinto; and the elastic member disposed between the discharging part and the cap part to apply the elastic force to the discharging part, wherein the elastic member is a bellows type member sealed on a peripheral surface thereof, the elastic member comprising:

a body having at least one peak and at least one trough in a longitudinal direction and configured to generate the elastic force upon compression; and a supporter located at a first end of the body proximal to the discharging part and configured to transfer the elastic force to the discharging part, wherein the body is bent at a first curvature between one peak and an adjacent trough, and the supporter extends outward from a terminal trough defining the first end of the body and is bent inward from the first end of the body at a second curvature different from the first curvature.

2. The container according to claim 1, wherein when the container part is pressurized, the content is introduced into the connection part through the at least one or more inlets, thereby compressing the elastic member and ascending the discharging part to open the outlet, and when the pressurization against the container part is released, the elastic member pressurizes the discharging part downward and descends the discharging part to close the outlet.

3. The container according to claim 1, wherein an inner upper peripheral surface of the body comes into close contact with the cap part and is supported against the cap part, and an outer lower peripheral surface of the supporter comes into close contact with the discharging part and is supported against the discharging part.

4. The container according to claim 1, wherein the container part comprises:

a soft storage part configured to store the content therein; and a hard shoulder part coupled to a top of the storage part.

5. The container according to claim 1, wherein the connection part comprises:

a seating portion seated on top of the container part and having the at least one or more inlets defined thereon; and an opening and closing rod extending upward from a given region of the seating portion inside the at least one or more inlets and configured to directly contact with an inside of the outlet.

6. The container according to claim 5, wherein, when the container part is pressurized, the discharging part ascends to a position where the opening and closing rod disengages the outlet to allow the content to be discharged through the outlet.

7. The container according to claim 5, wherein the connection part has a peripheral wall extending upward from a given region of the seating portion outside the at least one or more inlets, and the discharging part has a ring portion directly contacting the peripheral wall while the discharging part ascends and descends along the connection part to prevent the content from leaking.

8. The container according to claim 1, wherein the cap part comprises:

a first cap part configured to surround the connection part and having the insertion hole defined thereon; and a second cap part rotatably coupled to the first cap part and configured to open and close the insertion hole.

9. The container according to claim 8, wherein top of the discharging part is aligned with top of the insertion hole or located inside the insertion hole, and when the container part is pressurized, the discharging part ascends and becomes exposed to an outside from the insertion hole.

10. The container according to claim 1, wherein the second curvature is greater than the first curvature.

11. The container according to claim 10, wherein, upon the compression of the elastic member, the body is compressed at a first compression rate to generate the elastic force and allow the discharging part to ascend, and the supporter is compressed at a second compression rate lower than the first compression rate to stably transfer the elastic force to the discharging part to descend the discharging part.

* * * * *